United States Patent [19]

Holzapfel

[11] 4,050,238

[45] Sept. 27, 1977

[54] FILM EVAPORATING COMBUSTION CHAMBER

[75] Inventor: Immanuel Holzapfel, Stuttgart, Germany

[73] Assignee: Daimler-Benz Aktiengesellschaft, Germany

[21] Appl. No.: 667,273

[22] Filed: Mar. 15, 1976

[30] Foreign Application Priority Data

Mar. 14, 1975 Germany ..... 2511172

[51] Int. Cl.[2] ..... F02C 7/22

[52] U.S. Cl. ..... 60/39.23; 60/39.65; 60/39.71; 431/116

[58] Field of Search ..... 60/39.65, 39.71, 39.74 R, 60/39.74 B, 39.52, 39.23; 431/115, 116

[56] References Cited

U.S. PATENT DOCUMENTS

| | | | |
|---|---|---|---|
| 2,621,477 | 12/1952 | Powter et al. | 60/39.23 |
| 3,121,996 | 2/1964 | Smith | 60/39.74 B |
| 3,648,457 | 3/1972 | Bobo | 60/39.74 R |
| 3,703,259 | 11/1972 | Sturgess et al. | 60/39.74 B |
| 3,744,242 | 7/1973 | Stettler et al. | 60/39.52 |
| 3,826,083 | 7/1974 | Brandon et al. | 60/39.65 |
| 3,927,958 | 12/1975 | Quinn | 60/39.52 |
| 3,946,552 | 3/1976 | Weinstein et al. | 60/39.74 R |
| 3,961,475 | 6/1976 | Wood | 60/39.71 |

*Primary Examiner*—Carlton R. Croyle
*Assistant Examiner*—Robert E. Garrett
*Attorney, Agent, or Firm*—Craig & Antonelli

[57] ABSTRACT

A film evaporating combustion chamber, especially for vehicle gas turbines, which includes a radial guide cascade as guide wheel connected upstream of the inlet aperture of an evaporator pipe, which serves for producing a swirl of the combustion air; a pipe-shaped air guide housing encloses the evaporator pipe and an adjoining reaction chamber; the combustion air axially entering into the air guide housing is fed to the radial guide cascade from the outside by way of a deflection device inserted into the air guide housing and the air, after leaving the blade channels of the radial guide cascade, is then deflected in the axial direction.

35 Claims, 2 Drawing Figures

FILM EVAPORATING COMBUSTION CHAMBER

Figure 1:
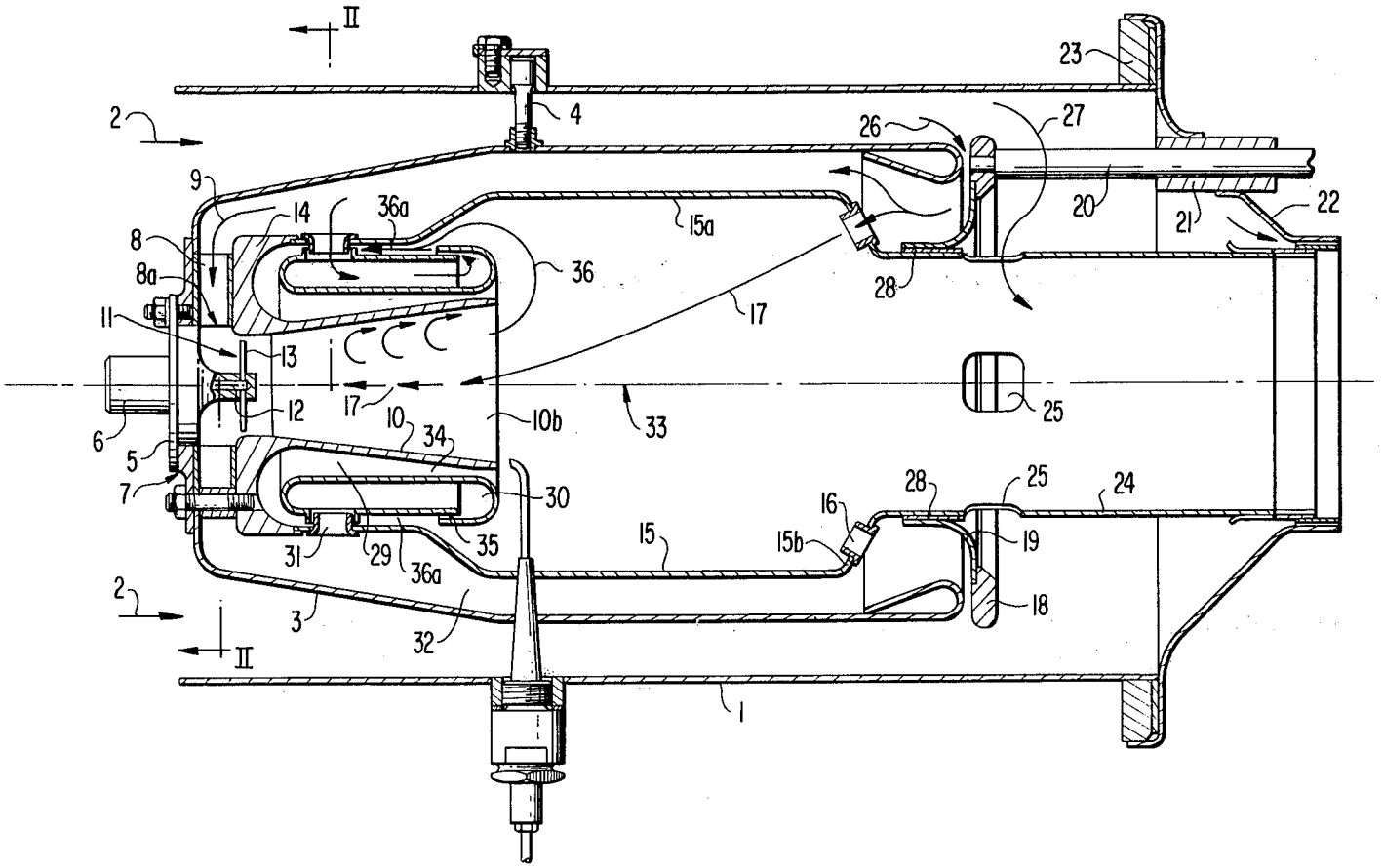

The present invention relates to a film-evaporating combustion chamber, especially for vehicle gas turbines, with a guide wheel connected upstream of the inlet side of an evaporator pipe and serving to produce a swirl or rotating movement of the combustion air and with a pipe-shaped air guide housing enclosing the evaporator pipe and an adjoining reaction chamber.

Film-evaporating combustion chambers of this type are known in the art (Motortechnische Zeitschrift 1959, Page 284). They have proved as very advantageous especially as solution of the problem to keep the exhaust gases soot-free and to achieve a disappearing nitrogen-oxide emission with good combustion above all also in the partial load range. This can be led back essentially to the fact that a molecular mixing of the fuel with air prior to the entry into the combustion zone, properly speaking, is made possible by the film evaporation and that as a result thereof locally high combustion temperatures are avoided and more particularly below temperatures at which takes place the thermal splitting of the fuel molecules, the so-called "cracking". It is known that this cracking reduces the reaction velocity and leads to the soot-formation.

In order to attain such a progress of the mixing preparation and of the combustion, it is necessary that the fuel is distributed as uniformly as possible as film onto the inner wall of the evaporator pipe and that the combustion air flows with a swirl through this evaporator pipe. Simultaneously, care must be taken for the fact that the temperature of the evaporator surface does not rise so high that the liquid fuel cracks; however, the temperature must lie above the boiling temperature of the main component of the fuel. In the prior art types of construction, the larger portion of the heat quantity required for the evaporation is thereby transmitted by the combustion gases themselves by turbulent convection onto the fuel film and more particularly in that a sink is formed in the evaporator pipe within the swirl core of the rotating flow, in which the combustion gases flow back. A strongly formed swirling flow increases the fuel- and heat-exchange and therewith the mixing velocity of fuel and air respectively of back-flowing combustion gases and stabilizes the fuel film during the evaporation. It is therefore of decisive importance that a rotating or swirling flow which is as good as possible is attained and that to the extend possible, also the return-flow into the swirling or rotating jet is enhanced.

In the prior art types of construction of film-evaporating combustion chambers, the swirl flow is attained by the arrangement of axial guide wheels; however, the disadvantage is accepted in these prior art constructions that the utilized axial guide wheels have a relatively large hub, behind or downstream of which generally a zone or region will form on the inside of the swirling jet, in which the mixing velocity is low by reason of the slight relative velocity differences of the substances coming into contact with each other so that relatively long evaporating pipe distances are required.

The present invention is therefore concerned with the task to propose a construction improved from an aerodynamic point of view of the combustion air supply to the evaporator pipe with the aim to increase the recirculation on the inside of the swirl jet and therewith to increase the substance- and heat-exchange in order that as rapid as possible a mixing is achieved and in this manner a compact type of construction is made possible with the same power output.

The present invention essentially consists in that a radial guide cascade is provided as guide wheel, to which the combustion air entering axially into the air guide housing is conducted from the outside by way of a deflection device inserted into the air guide housing and in which the combustion air, after leaving the more or less tangentially directed blade channels, is deflected in the axial direction, whereby the inner contour of this deflection terminates or runs out essentially in the direction toward the center of the shaft. Radial guide cascades with a high circumferential discharge velocity exhibit smaller losses compared to axial swirl cascades with an equally large discharge swirl and with a small hub and enable, because no hub is present, a back-flow within the core of the swirling flow up to the guide wheel outlet or discharge. As a result thereof, the recirculation flow is decisively influenced and better results can be attained as regards efficiency and intensity of the mixing. A further improvement can be additionally achieved in that the outer walls of the deflecting channel between the guide cascade outlet and the evaporator pipe are aligned with the walls of the evaporator pipe and in that the evaporator pipe is constructed so as to become conically enlarged starting from the guide cascades. The cone is thereby so designed and constructed that no detachment occurs whereas the conical enlargement displaces the zone of greatest turbulence radially outwardly and it is achieved as a result thereof that the substance- and heat-exchange as also the recirculation flow are significantly improved.

A further improvement can be achieved in the end of the evaporator pipe opposite the guide cascade projects freely into the reaction chamber which has a considerably larger diameter than the evaporator pipe. With this construction, the walls of the reaction chamber may be extended up to the inlet side of the blade channels of the radial guide cascade so that an annular space surrounding the evaporator pipe is formed between the evaporator pipe and reaction chamber, in which a back-flow is induced by the evaporator pipe freely projecting into the reaction chamber and by the swirling flow leaving this evaporator pipe, which back-flow enhances the re-transmission of combustion heat onto the evaporator pipe by convective heat transfer particularly during starting- and acceleration-operations as well as at small loads. On the other hand, at large loads no undesired heat is conducted from the hot walls of the reaction zone into the evaporator pipe, which is a particular disadvantage of prior art combustion chamber constructions. This can be still further improved in a particularly advantageous manner in that an ejector ring is inserted into this annular space, which is in communication by way of inlet openings with the air inlet space enclosed by the deflection device and which is provided with a circularly shaped outflow or discharge slot directed approximately parallel to the outer wall of the reaction chamber. If this discharge or outflow slot is arranged on the outer circumference of the ejector ring and is open in the direction toward the guide cascade, then it is possible to intentionally influence thereby a back-flow, by means of a back-flow of combustion gases takes place at the evaporator pipe in the direction toward the discharge outlet, which contributes to heat-up the walls of the evaporator pipe. Simultaneously therewith, however, an intensive mixing is assured also at the free end of the evaporator pipe, especially if the ejector ring has an elongated cross section extending approximately parallel to the axis of the evaporator pipe and if a flow-space that narrows ring-nozzle-shaped in the direction toward the free end of the evaporator pipe is formed between its inner diameter and the outer circumference of the evaporator pipe and if the recirculation both in the reaction zone as also in the evaporator pipe is enhanced by sucking off combustion gases out of the outer part of the reaction space.

If with this type of construction the deflection device is constructed as a hood closed on the side of the air inlet into the air guide housing, which encases the reaction chamber with a spacing and at the open end adjoins an axially displaceable throttle ring, then additionally the problem can be solved in a very simple and effective manner to control the combustion air supply to the evaporator pipe whereby simultaneously the outer walls of the reaction chamber can be cooled in the desired relationship. The reaction chamber may additionally be provided within the area of the throttle ring with openings uniformly distributed over the circumference, through which additional combustion air can be conducted in the direction toward the core of the swirl-shaped mixture of fuel vapor, air and combustion products leaving the evaporator pipe. Also as a result of this particular constructional feature, a further mixing intensification can be achieved in this embodiment, especially if the openings are constructed in the form of nozzles.

However, this type of construction is suitable also quite particularly as solution to the task to establish the optimum condition as regards harmful emission and combustion stability between combustion air and thinning air by a single adjusting movement without complicated mechanisms, and more particularly if the reaction chamber is provided with an adjoining flame tube that is provided with inlet apertures distributed over the circumference for the supply of thinning air and if the throttle ring is coupled with a slide ring surrounding the flame tube and axially displaceable on the flame tube, which opens and closes the inlet openings for the thinning air in the reverse sense in which the throttle ring closes and opens up the inlet cross section at the free end of the hood. An opposite control of the supply of combustion air and thinning air can be achieved therewith in a very simple manner so that the overall pressure loss of the combustion chamber is changed only insignificantly.

Accordingly, it is an object of the present invention to provide a film-evaporating combustion chamber which avoids by simple means the aforementioned shortcomings and drawbacks encountered in the prior art.

Another object of the present invention resides in a film-evaporating combustion chamber, especially for vehicle gas turbines, which not only assures an essentially soot-free operation accompanied by low nitrogenoxide emission but which also enables a relatively short, compact overall construction.

A further object of the present invention resides in a film-evaporating combustion chamber, in which the mixing velocity of the substances coming in contact with one another, such as the fuel, the combustion air and the recirculated combustion gases, is relatively high in all areas of the evaporating zone.

Still a further object of the present invention resides in a film-evaporating combustion chamber which offers greater efficiency and intensity as regards mixing of fuel and combustion air.

Still another object of the present invention resides in a film-evaporating combustion chamber of the type described above in which the substance-exchange and heat-exchange as also the recirculation flow are considerably improved.

A further object of the present invention resides in a film-evaporating combustion chamber, in which the need for heat in the evaporator pipe during starting and at small loads is taken into proper consideration without causing overheating thereof at larger loads.

Another object of the present invention resides in a film-evaporating combustion chamber in which optimum conditions as regards harmful substance emission and combustion stability are maintained between combustion air and thinning air by extremely simple means.

Figure 2:
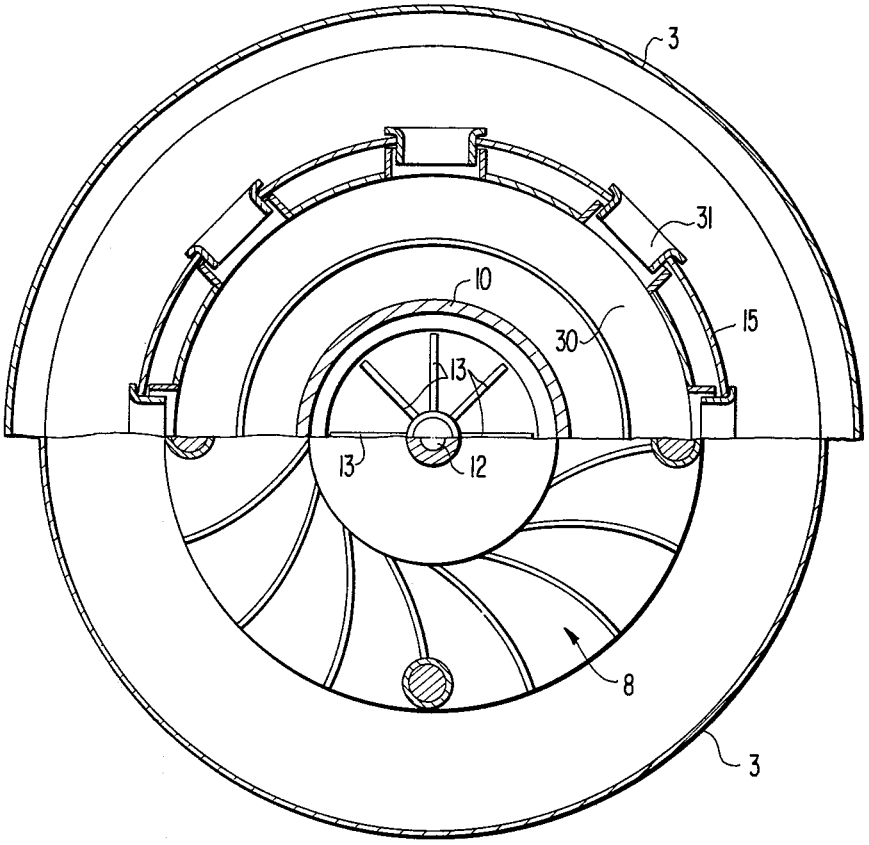

These and other objects, features and advantages of the present invention will become apparent from the following description when taken in conjunction with the accompanying drawing which shows, for purpose of illustration only, one embodiment in accordance with the present invention, and wherein:

FIG. 1 is a somewhat schematic longitudinal cross-sectional view through a film-evaporating combustion chamber in accordance with the present invention, and FIG. 2 is a cross-sectional view through a film-evaporating combustion chamber of FIG. 1, taken along line II—II thereof.

Referring now to the drawing wherein like reference numerals are used throughout the two views to designate like parts, reference numeral 1 designates in these two figures a tubularly shaped air guide housing. A hood 3 closed in the direction toward the inflow direction 2 of the air is inserted into the air guide housing 1, which is secured by several radially extending bolts 4, of which one is shown in FIG. 1. A member 6 for the accommodation of the fuel supply installation is flangedly connected to the hood 3 at the closed end thereof by way of flange 5. A radial guide cascade generally designated by the reference numeral 7 is constructed with straight or curved blade channels 8 (FIGS. 1 and 2); the air thereby flows into these blades channels 8 radially from the outside in the direction of the arrows 9 while the blade channels 8 deflect the air in the circumferential direction up to the blade channel outlet or discharge so that the air, after discharge out of the blade channels 8 and after a slight deflection in the axial direction, flows with a high circumferential velocity, i.e., with a strong swirl, into the evaporator pipe 10 which is conically enlarged after a short cylindrical distance.

In the illustrated embodiment, the evaporator pipe 10 is rigidly connected with the radial guide cascasde 7 or also is made in one piece therewith whereas the inner contour of the transition channel generally designated by the reference numeral 11 (FIG. 1) between the outlet 8*a* of the blade channels 8 and the evaporator pipe 10 is formed by the member 6, in which is arranged a supply channel 12 (FIGS. 1 and 2) for the fuel which is provided with radially projecting small pipes 13, through which the fuel is conducted directly against the inner wall of the evaporator pipe 10 in order to form thereat, assisted by the swirling flow, a thin film which evaporates at temperatures that lie still below the temperature at which the fuel cracks. The evaporating fuel is seized by the swirl jet of the combustion air and mixed with the same.

The radial guide cascade 7 continues at the inlet portion of the blade channels 8 into a cylindrical portion 14 which is adjoined by the outer wall 15*a* of a reaction chamber 15 whose cross-section increases approximately in the area in which the free end of the evaporator pipe 10 is seated. The reaction chamber 15*a* may be made appropriately of silicon carbide or the like (SiC or $Si_3N_4$) in order that the temperatures can be selected higher at the inlet and outlet of the combustion chamber with a view toward smallest possible fuel consumption. The reaction chamber 15 narrows in its cross section within the area of the end of the hood 3 whereby nozzle-shaped openings 16 are provided within this area, through which combustion air can be sent once again into the reaction chamber 15 and, as indicated by the arrows 17, into the center of the hollow jet passing through the evaporator pipe 10. This is achieved in that an axially displaceable throttle ring 18 is arranged at the end of the hood 3 which is provided with a sheet-metal deflection ring 19 and can be axially displaced together with the same with the aid of the adjusting rods 20. The adjusting rods 20 are thereby seated in bearing supports 21 which are mounted securely at a closure cover 22 which is connected at the flange 23 with the air guide housing 1. The closure cover 22 receives on the inside thereof a flame tube 24 which is provided within the area of the throttle ring 18 with openings 25 distributed over the circumference, through which thinning air can be conducted to the reaction mixture from the air guide housing 1. In order to control the ratio between combustion air, entering along the arrows 26 into the intermediate space between the hood 3 and the reaction chamber 15, and the thinning air, entering along the arrows 27 through the openings 25, the deflecting ring 19 is connected with a slide ring 28 which is displaced in this manner in unison with the throttle ring 18 and thus takes care for an opening or closing of the openings 25. This control operation thereby takes place in the opposite sense to the opening of the inlet cross section at the hood 3 so that by adjustment of the throttle ring 18 a control in the opposite sense is automatically established between the thinning air and the combustion air in a very effective manner. If the cross section between the throttle ring 18 and the open end of the hood 3 is increasingly opened, then at the same time the free cross section of the openings 25 is increasingly closed so that the entire pressure loss of this arrangement remains essentially the same. A very simple combustion air control can be achieved in this manner.

An ejector ring 30 is inserted into the annular space 29 formed between the reaction chamber wall 15*a* and the evaporator pipe 10, in which a recirculation flow is established already as such during the operation of the evaporator combustion chamber; the ejector ring 30 is connected by way of the openings 31 with the space 32 between the hood 3 and the reaction chamber 15. The ejector ring 30 has an elongated cross section and extends essentially parallel to the axis 33 of the combustion chamber so that an annular space 34 (FIG. 1) is formed between the evaporator pipe 10 and the inner circumference of the ejector ring 30 which narrows nozzle-like toward the free end of the evaporator pipe 10. The ejector ring 30 includes a ring-shaped outlet or discharge slot 35 which is seated on the outside of the ejector ring 30 and which is open in the direction toward the inlet end of the blade channels 8. As a result of the jet which is formed during the operation and which leaves the slot 35, a reaction mixture is thus sucked by the ejector effect out of the reaction chamber 15 in the direction of the arrows 36 and is sent back again into the reaction chamber 15 by way of the nozzle ring space 34. Consequently, the mixing and combustion process can be intentionally controlled by this controlled back-flow and above all can be intensified. The openings 31 and the annular gap 35 are so dimensioned that the air quantity entering through the openings 31 is determined exclusively by the cross section of the annular gap 35. The cross sections of the annular gap 35 and of the annular channel 36*a* are so matched to one another that the combustion gap quantity which is supplied by the momentum exchange within the annular channel 36*a,* as mixture together with the air entering the annular channel 36*a* through gap 35 with a predetermined temperature is conditioned on its way through the annular gap 34 to heat the evaporator pipe 10 to the temperature required for the evaporation of the fuel film. The temperature of the evaporator pipe 10 should thereby lie at its inlet side above the boiling temperature of the main component of the fuel. The heating up of the evaporator pipe 10 can thus be controlled independently of the wall temperature of the reaction chamber 15 preferably by the supplied combustion air quantity which, in its turn, is metered by the position of the throttle ring 18.

Beyond this task the siphoning-off of combustion gases out of the outer portion of the reaction chamber 15 will lead under all operating conditions to an enhanced deflection of the mixture leaving the evaporator pipe 10 and therewith to an enhanced recirculation both in the reaction zone as also in the swirl core of the downstream end 10b of the evaporating- and mixing-zone.

The aforementioned openings 16 in the closure wall 15*b* of the reaction chamber 15 in the direction toward the flame tube 24 serve the same purpose. The air jets 17 entering through these openings 16 induce together with the sink produced by the swirl flow in the evaporator pipe 10, within the section 10*b* in conjunction with the effect of the ejector 30 a strong recirculation flow and a better mixing of fuel vapor/air mixture with the combustion products. It thus becomes possible by the novel film-evaporating combustion chamber of the present invention to enhance the mixing- and combustion-process so that with the same output, the entire structural length of the film-evaporating combustion chamber can be kept shorter, even though the aimed-at goal to achieve a soot-free combustion low in nitrogen oxides, remains preserved.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A film-evaporating combustion chamber, comprising an evaporator pipe means for evaporating a film of fuel distributed on an inner surface thereof, guide wheel means operable to produce a swirl of the combustion air and operatively connected ahead of an inlet opening of the evaporator pipe means, and tubularly shaped air guide housing means for guiding combustion air from outside in a substantially axial direction, the air guide housing means enclosing the evaporator pipe means and an adjoining reaction chamber means, characterized in that a radial guide cascade means having blade channel means is provided as guide wheel means, deflection means are arranged inside of the air guide housing means for supplying the substantially axially entering combustion air to the radial guide cascade means, the combustion air being deflected substantially in the axial direction after leaving the blade channel means of the radial guide cascade means, and in that an annular space means is provided for inducing a back flow of combustion air from the reaction chamber means to an area surrounding the evaporator pipe means, said annular space means is defined between an outer surface of the evaporator pipe means and an inner surface of wall means of the reaction chamber means which extend up to an inlet side of the blade channel means of the radial guide cascade means.

2. A film-evaporating combustion chamber according to claim 1, characterized in that an inner contour of the deflection means runs out essentially in a direction toward an axis of the guide wheel means.

3. A film-evaporating combustion chamber according to claim 2, characterized in that the combustion chamber forms part of a vehicle gas turbine.

4. A film-evaporating combustion chamber according to claim 2, characterized in that outer walls of the blade channel means are substantially aligned at an outlet side thereof with wall means of the evaporator pipe means, said evaporator pipe means being enlarged substantially conically from the radial guide cascade means.

5. A film-evaporating combustion chamber according to claim 4, characterized in that an end of the evaporator pipe means opposite the radial guide cascasde means projects freely into the reaction chamber means which has a substantially larger diameter.

6. A film-evaporating combustion chamber according to claim 1, characterized in that an ejector ring means is inserted into the annular space means, inlet opening means are provided for communicating the annular space means with an air inlet space enclosed by the deflection means, and in that the annular spaced means is provided with an essentially circularly shaped discharge slot means directed approximately parallel to an outer wall of the reaction chamber means.

7. A film-evaporating combustion chamber comprising an evaporator pipe means, guide wheel means operable to produce a swirl of the combustion air and operatively connected ahead of an inlet opening of the evaporator pipe means, and tubularly shaped air guide housing means for guiding combustion air from the outside in a substantially axial direction, the air guide housing means enclosing the evaporator pipe means and an adjoining reaction chamber means, characterized in that a radial guide cascade means having blade channel means is provided as guide wheel means, deflection means are arranged inside of the air guide housing means for supplying the substantially axially entering combustion air to the radial guide cascade means, the combustion air being deflected substantially in the axial direction after leaving the blade channel means of the radial guide cascade means, an inner contour of the deflection means runs out essentially in a direction toward an axis of the guide wheel means, outer walls of the blade channel means are substantially aligned at an outlet side thereof with wall means of the evaporator pipe means, said evaporator pipe means being enlarged substantially conically from the radial guide cascade means with an end of the evaporator pipe means opposite the radial guide cascade means projecting freely into the reaction chamber means which has a substantially larger diameter, wall means of the reaction chamber means are extended up to the inlet side of the blade channel means of the guide cascade means so as to define an annular space surrounding the evaporator pipe means between the evaporator pipe means and the reaction chamber means, an ejector ring means is inserted into the annular space, inlet opening means are provided for communicating the annular space with an air inlet space enclosed by the deflection means, the annular space is provided with an essentially circularly shaped discharge slot means directed approximately parallel to an outer wall of the reaction chamber means, and in that the discharge slot means is arranged along an outer circumference of the ejector ring means and is open in a direction toward the radial guide cascade means.

8. A film-evaporating combustion chamber according to claim 7, characterized in that the ejector ring means have an elongate cross section extending approximately parallel to an axis of the evaporator pipe means, and in that a flow space means is formed between an inner diameter of the ejector ring means and an outer circumference of the evaporator pipe means, said flow space means becoming narrower in the direction toward a free end of the evaporator pipe means.

9. A film-evaporating combustion chamber according to claim 8, characterized in that the radial guide cascade means and the evaporator pipe means are made in one piece and in that wall means of the reaction chamber means are affixed in an inlet area of the guide cascade means.

10. A film-evaporating combustion chamber according to claim 9, characterized in that the deflection means is constructed as a hood means closed in a direction toward a side of an air inlet into the air guide housing means, the hood means surrounding the reaction chamber means with a spacing and being adjoined at an open end thereof by an axially displaceable throttle ring means.

11. A film-evaporating combustion chamber according to claim 10, characterized in that the reaction chamber means is provided with a closure wall, the closure wall being provided within an area of the throttle ring means with opening means distributed substantially uniformly over the circumference for conducting additional combustion air toward a center of a reaction jet leaving the evaporator pipe means in a swirl shape.

12. A film-evaporating combustion chamber according to claim 11, characterized in that said last-mentioned opening means are constructed in the shape of nozzles.

13. A film-evaporating combustion chamber according to claim 12, with a flame tube means adjoining the reaction chamber means, said flame tube means being provided with inlet opening means distributed over the circumference for the supply of secondary thinning air, characterized in that the throttle ring means is operatively connected with a slide ring means surrounding the flame tube means and axially displaceable on the flame tube means, said slide ring means being operable to open and close an inlet opening means for the supply of thinning air in the opposite sense in which the throttle ring means closes and opens an inlet of the hood means.

14. A film-evaporating combustion chamber according to claim 13, characterized in that the slide ring means is connected with the throttle ring means by way of a deflection member.

15. A film-evaporating combustion chamber according to claim 14, characterized in that the air guide housing means is closed off downstream of the throttle ring means with a closure cover.

16. A film-evaporating combustion chamber according to claim 15, characterized in that adjusting rod means are provided for adjusting the throttle ring means, and in that guide means for guiding the adjusting rods are provided in the closure cover.

17. A film-evaporating combustion chamber according to claim 16, characterized in that a fuel supply means is arranged substantially in a center of the radial guide cascade means.

18. A film-evaporating combustion chamber according to claim 17, characterized in that small distributor pipe means extend radially outwardly from the fuel supply means toward wall means of the evaporator pipe means.

19. A film-evaporating combustion chamber according to claim 18, characterized in that at least one of the reaction chamber means and the flame tube means is made from a material selected from the group consisting of SiC and $Si_3N_4$.

20. A film-evaporating combustion chamber according to claim 1, characterized in that outer walls of the blade channel means are substantially aligned at an outlet side thereof with wall means of the evaporator pipe means, said evaporator pipe means being enlarged substantially conically from the radial guide cascade means.

21. A film-evaporating combustion chamber according to claim 1, characterized in that an end of the evaporator pipe means opposite the radial guide cascade means projects freely into the reaction chamber means which has a substantially larger diameter.

22. A film-evaporating combustion chamber, comprising an evaporator pipe means, guide wheel means operable to produce a swirl of the combustion air and operatively connected ahead of the inlet opening of the evaporator pipe means, and tubularly shaped air guide housing means enclosing the evaporator pipe means and an adjoining reaction chamber means, characterized in that a radial guide cascade means having blade channel means is provided as guide wheel means, the combustion air entering substantially axially into the air guide housing means being supplied to the radial guide cascade means from the outside by way of a deflection means arranged inside of the air guide housing means, the combustion air being deflected substantially in the axial direction after leaving the blade channel means of the radial guide cascade means, wall means of the reaction chamber means are extended up to the inlet side of the blade channel means of the guide cascade means so that an annular space surrounding the evaporator pipe means is formed between the evaporator pipe means and the reaction chamber means, and in that an ejector ring means is inserted into the annular space, which is in communication by way of inlet opening means with the air inlet space enclosed by the deflection means and is provided with an essentially circularly shaped discharge slot means directed approximately parallel to the outer wall of the reaction chamber means.

23. A film-evaporating combustion chamber, comprising an evaporator pipe means, guide wheel means operable to produce a swirl of the combustion air and operatively connected ahead of an inlet opening of the evaporator pipe means, and tubularly shaped air guide housing means for guiding combustion air from outside in a substantially axial direction, the air guide housing means enclosing the evaporator pipe means and an adjoining reaction chamber means, characterized in that a radial guide cascade means having blade channel means is provided as guide wheel means, deflection means are arranged inside of the air guide housing means for supplying the substantially axially entering combustion air to the radial guide cascade means, the combustion air being deflected substantially in the axial direction after leaving the blade channel means of the radial guide cascade means, wall means of the reaction chamber means are extended up to an inlet side of the blade channel means of the guide cascade means so as to define an annular space surrounding the evaporator pipe means between the evaporator pipe means and the reaction chamber means, an ejector ring means is inserted into the annular space, inlet opening means are provided for communicating the annular space with an air inlet space enclosed by the deflection means, the annular space is provided with an essentially circularly shaped discharge slot means directed approximately parallel to an outer wall of the reaction chamber means, and in that the discharge slot means is arranged along an outer circumference of the ejector ring means and is open in a direction toward the radial guide cascade means.

24. A film-evaporating combustion chamber, comprising an evaporator pipe means, guide wheel means operable to produce a swirl of the combustion air and operatively connected ahead of an inlet opening of the evaporator pipe means, and tubularly shaped air guide housing means for guiding combustion air from outside in a substantially axial direction, the air guide housing means enclosing the evaporator pipe means and an adjoining reaction chamber means, characterized in that a radial guide cascade means having blade channel means is provided as guide wheel means, deflection means are arranged inside of the air guide housing means for supplying the substantially axially entering combustion air to the radial guide cascade means, the combustion air being deflected substantially in the axial direction after leaving the blade channel means of the radial guide cascade means, wall means of the reaction chamber means are extended up to an inlet side of the blade channel means of the guide cascade means so as to define an annular space surrounding the evaporator pipe means between the evaporator pipe means and the reaction chamber means, an ejector ring means is inserted into the annular space, inlet opening means are provided for communicating the annular space with an air inlet space enclosed by the deflection means, the annular space is provided with an essentially circularly shaped discharge slot means directed approximately parallel to an outer wall of the reaction chamber means, and in that the ejector ring means has an elongated cross section extending approximately parallel to an axis of the evaporator pipe means, and in that a flow space means is formed between an inner diameter of the ejector ring means and an outer circumference of the evaporator pipe means, said flow space means becoming narrower in the direction toward a free end of the evaporator pipe means.

25. A film-evaporating combustion chamber according to claim 1, characterized in that the radial guide cascade means and the evaporator pipe means are made in one piece and in that wall means of the reaction chamber means are affixed in an inlet area of the guide cascade means.

26. A film-evaporating combustion chamber, comprising an evaporator pipe means, guide wheel means operable to produce a swirl of the combustion air and operatively connected ahead of an inlet opening of the evaporator pipe means, and tubularly shaped air guide housing means for guiding combustion air from outside in a substantially axial direction, the air guide housing means enclosing the evaporator pipe means and an adjoining reaction chamber means, characterized in that a radial guide cascade means having blade channel means is provided as guide wheel means, deflection means are arranged inside of the air guide housing means for supplying the substantially axially entering combustion air to the radial guide cascade means, the combustion air being deflected substantially in the axial direction after leaving the blade channel means of the radial guide cascade means, and in that the deflection means is constructed as a hood means closed in a direction toward a side of an air inlet into the air guide housing means, the hood means surrounding the reaction chamber means with a spacing and being adjoined at an open end thereof by an axially displaceable throttle ring means.

27. A film-evaporating combustion chamber according to claim 26, characterized in that the reaction chamber means is provided with a closure wall, the closure wall being provided within an area of the throttle ring means with opening means for conducting additional combustion air a center of a reaction jet leaving the evaporator pipe means in a swirl shape.

28. A film-evaporating combustion chamber according to claim 27, characterized in that said last-mentioned opening means are constructed in the shape of nozzles.

29. A film-evaporating combustion chamber according to claim 26, with a flame tube means adjoining the reaction chamber means, said flame tube means being provided with inlet opening means for the supply of secondary thinning air, characterized in that the throttle ring means is operatively connected with a slide ring means surrounding the flame tube means and axially displaceable on the flame tube means, said slide ring means being operable to open and close an inlet opening means for the supply of thinning air in the opposite sense in which the throttle ring means closes and opens an inlet of the hood means.

30. A film-evaporating combustion chamber according to claim 29, characterized in that the slide ring means is connected with the throttle ring means by way of a deflection member.

31. A film-evaporating combustion chamber according to claim 26, characterized in that the air guide housing means is closed off downstream of the throttle ring means with a closure cover.

32. A film-evaporating combustion chamber according to claim 31, characterized in that adjusting rod means are provided for adjusting the throttle means, and in that guide means for guiding the adjusting rods are provided in the closure cover.

33. A film-evaporating combustion chamber according to claim 1, characterized in that a fuel supply means is arranged substantially in the center area of the radial guide cascade means.

34. A film-evaporating combustion chamber according to claim 33, characterized in that small distributor pipe means extend radially outwardly from the fuel supply means toward wall means of the evaporator pipe means.

35. A film-evaporating combustion chamber according to claim 18, characterized in that both the reaction chamber means and the flame tube means is made from a material selected from the group consisting of SiC and $Si_3N_4$.

* * * * *